US005572815A

United States Patent [19]

Kovner

[11] Patent Number: 5,572,815

[45] Date of Patent: Nov. 12, 1996

[54] BUSINESS CARD HOLDER

[76] Inventor: Spencer Kovner, 317 N. Soto St. 6 & 7, Los Angeles, Calif. 90033

[21] Appl. No.: 362,573

[22] PCT Filed: Jan. 15, 1993

[86] PCT No.: PCT/US93/00772

§ 371 Date: Jul. 13, 1994

§ 102(e) Date: Jul. 13, 1994

Related U.S. Application Data

[63] Continuation-in-part of Ser. No. 577,332, Aug. 31, 1990, abandoned, and Ser. No. 652,278, Feb. 7, 1991, Pat. No. Des. 343,638.

[51] Int. Cl.[6] ..... B42F 3/00

[52] U.S. Cl. ..... 40/404; 40/405; 402/79

[58] Field of Search ..... 40/360, 391, 395, 40/401, 404, 405, 537; 402/79; 281/2, 5

[56] References Cited

U.S. PATENT DOCUMENTS

| | | | |
|---|---|---|---|
| 42,260 | 4/1864 | Roberts | 40/537 X |
| D. 310,098 | 8/1990 | Ristuccia, Sr. | D19/1 |
| 582,591 | 5/1897 | Salsberg | 40/530 |
| 1,220,354 | 3/1917 | Lodge | 70/159 |
| 2,298,571 | 10/1942 | Lindberg | 40/360 |
| 2,336,196 | 12/1943 | Sparling | 40/154 |
| 2,637,325 | 5/1953 | McCabe | 40/537 |
| 3,415,407 | 12/1968 | Alden et al. | 40/312 |
| 3,496,665 | 2/1970 | Goldman | 40/591 |
| 4,140,565 | 2/1979 | Parker et al. | 40/158.1 |
| 4,536,979 | 8/1985 | Parkinson | 40/124.2 X |
| 4,542,286 | 9/1985 | Gularz | 40/360 X |
| 4,708,503 | 11/1987 | Poor | 281/2 X |
| 4,849,056 | 7/1989 | Ristuccia, Sr. | 40/360 X |

FOREIGN PATENT DOCUMENTS

| | | | |
|---|---|---|---|
| 148952 | 11/1936 | Austria | 40/158.1 |

*Primary Examiner*—Brian K. Green

*Attorney, Agent, or Firm*—John J. Connors; Connors & Associates

[57] ABSTRACT

Disclosed is a holder for business cards with a rectangular area having holes at its corners with slits extending outward so that business cards larger than the standard business card may be removably mounted to the card holder.

3 Claims, 4 Drawing Sheets

BUSINESS CARD HOLDER

RELATED PATENT APPLICATION

This patent application is a continuation-in-part of U.S. patent application Ser. No. 07/577,332, filed Aug. 31, 1990, now abandoned, and entitled Business Card Holder, and U.S. patent application Ser. No. 07/652,278, filed Feb. 7, 1991, now U.S. Pat. No. Des.343,638, and entitled Business Card Holder. Both of these prior patent applications are incorporated herein by reference and made part of this patent application.

BACKGROUND OF THE INVENTION

1. Field of the Invention

This invention relates to a card holder which is adapted to hold business cards of different dimensions and to be removably mounted in a standard card storage and retrieval system.

2. Background Discussion

Card holders for use in standard storage and retrieval systems are well known. They are not, however, particularly suited to allow a conventional business card to be easily mounted thereon and later removed, if desired. The ideal card holder would be simple to manufacture, low cost, easy to use, and be capable of holding business cards which are larger than the standard business card. The standard business card size depends on the region of the world where one uses the card. In the United States the standard size is 2 inches by 3.5 inches. The present invention provides such a card holder.

SUMMARY OF THE INVENTION

The card holder of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENT," one will understand how the features of this invention provide its advantages, which include low cost manufacture, convenience and ease of use, and capacity to hold business cards of various sizes.

The first feature of this invention is that it removably holds a single business card within a card storage and retrieval system, and is designed to accommodate business cards of different sizes. The card holder of this invention has this capability because of the unique structure which captures and holds the business card. This structure includes a thin, but stiff, rectangular sheet with holes and slits extending from the holes which allow business cards of different sizes to be removably attached by inserting the corners of the business card in the holes. If the business card is larger than the standard size, its edges are slipped into the slits. There is at least one, preferably two adjacent, standard mounting cutouts in the sheet for attaching the card holder to the card storage and retrieval system.

The second feature is that the sheet has an outer longitudinal top edge, a pair of opposed outer side edges, and a outer bottom longitudinal edge of standard dimensions which enable the card holder of this invention to be mounted in standard card storage and retrieval systems. Specifically, the sheet has a width of 4 inches and a height between 2.5 and 2.70 inches. This provides the card holder with outside dimensions greater than the dimensions of the vast majority of business cards presently in use, yet enables it to be attached to a standard storage and retrieval system.

The third feature is that the sheet has a planar surface, a rectangular area displaced parallel to the planar surface a distance approximately equal to the thickness of the business card, and a marginal frame surrounding the rectangular area. The rectangular area has dimensions corresponding to the dimensions of a standard business card. The distance between the outer longitudinal edge and the displaced rectangular area is from 3/32 to 1/8 of an inch, the distance between each of the outer side edges and the displaced rectangular area is from 1/8 to 7/16 inch, and the distance between the outer longitudinal bottom edge and the displaced rectangular area is between 1/2 and 5/8 inch.

The forth feature is that a hole and associate slit are at each corner of the rectangular area. By inserting one corner of the business card into each hole, the business card is held generally within the rectangular area with a printed surface of the business card lying approximately in the planar surface and facing outward. Each hole is formed by a straight cut in the sheet oriented at approximately 45 degrees to a side edge. A portion of the rectangular area adjacent the cut is removed to allow the corners of the business card to be more easily inserted into the holes. Preferably, each hole is in the form of a segment of a circle.

The fifth feature is that extending from each hole is one or more slits which accommodate business cards having dimensions greater than the dimensions of a standard business card. Specifically, there is a first slit which parallels an adjacent side edge of the sheet and extends from the cut a distance of from 1/16 to 3/16 inch and terminates at a second slit. The second slit extends from the end of the first slit at an angle of from 40 to 50 degrees outward towards the adjacent side edge. The second slit has a length of an 1/16 to 3/16 inch.

The sixth feature is that the holes adjacent the bottom longitudinal edge of the sheet each have a third slit which parallels the bottom longitudinal edge and extends a distance of from 1/16 to 3/16 inch from the end of the cut and terminates at a forth slit. The forth slit extends from the end of the third slit at an angle of from 40 to 50 degrees outward towards the bottom longitudinal edge a distance of from 1/16 to 3/16 inch.

The seventh feature is that the first and third slits extend along the perimeter of the displaced rectangular area.

DESCRIPTION OF THE DRAWING

The preferred embodiment of this invention, illustrating all its features, will now be discussed in detail. This embodiment depicts the novel and non-obvious card holder of this invention shown in the accompanying drawing, which is for illustrative purposes only. This drawing includes the following figures (Figs.), with like numerals indicating like parts.

DESCRIPTION OF THE PREFERRED EMBODIMENT

Figures 1, 1A:
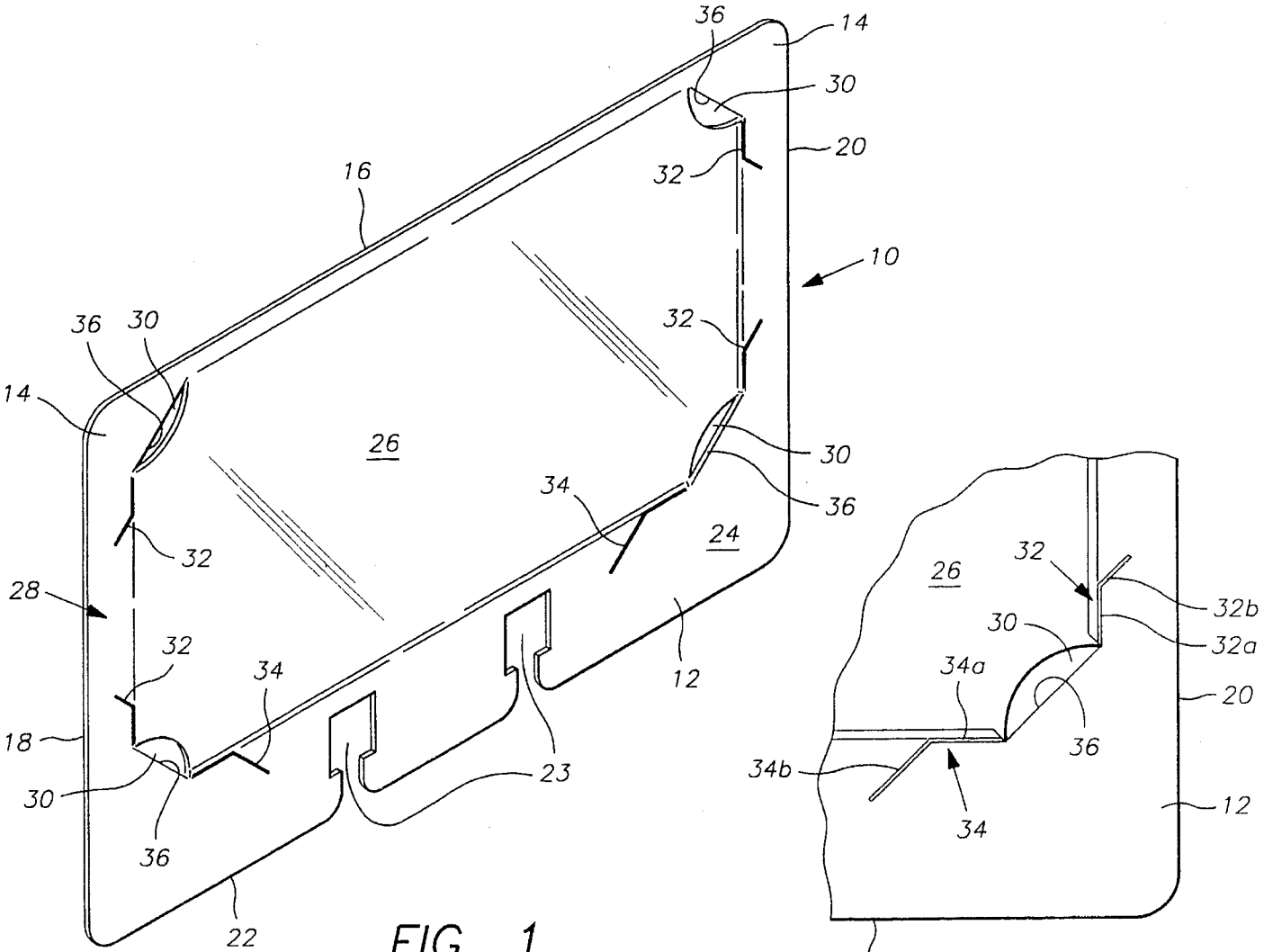
FIG. 1 is a perspective view of the card holder of this invention.
FIG. 1A is an enlarged, fragmentary view of a corner of the card holder of this invention.
Figure 3:
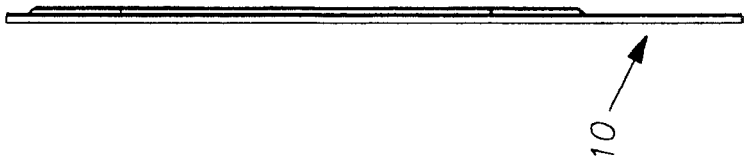
FIG. 3 is a right side edge view of the card holder of this invention.
Figure 2:
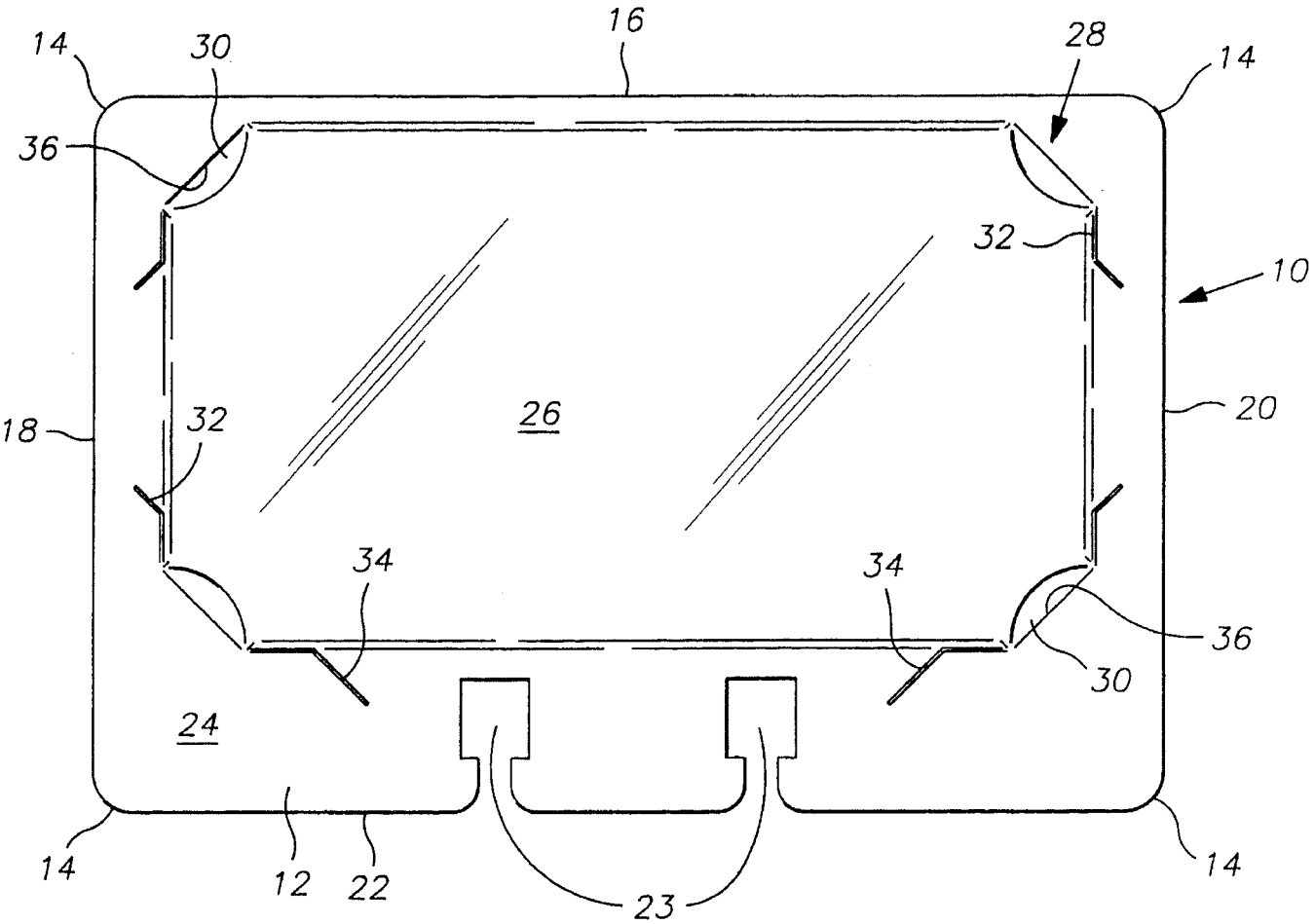
FIG. 2 is a front elevational view of the card holder of this invention.
Figure 4:
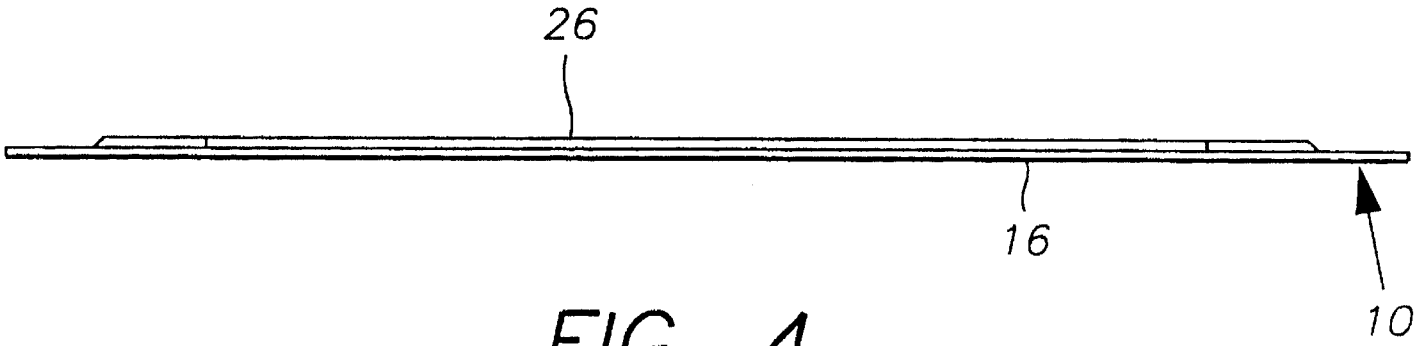
FIG. 4 is a top edge view of the card holder of this invention.
Figure 5:
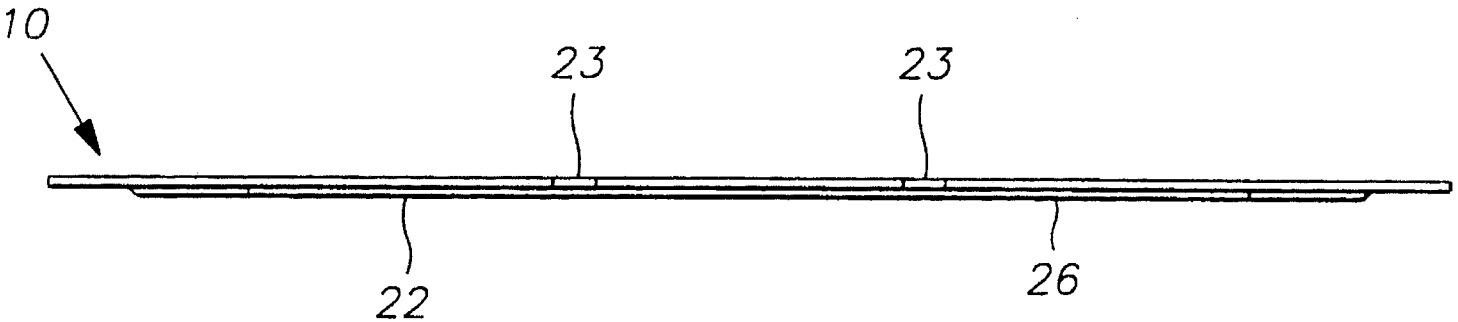
FIG. 5 is a bottom edge view of the card holder of this invention.
Figure 6:
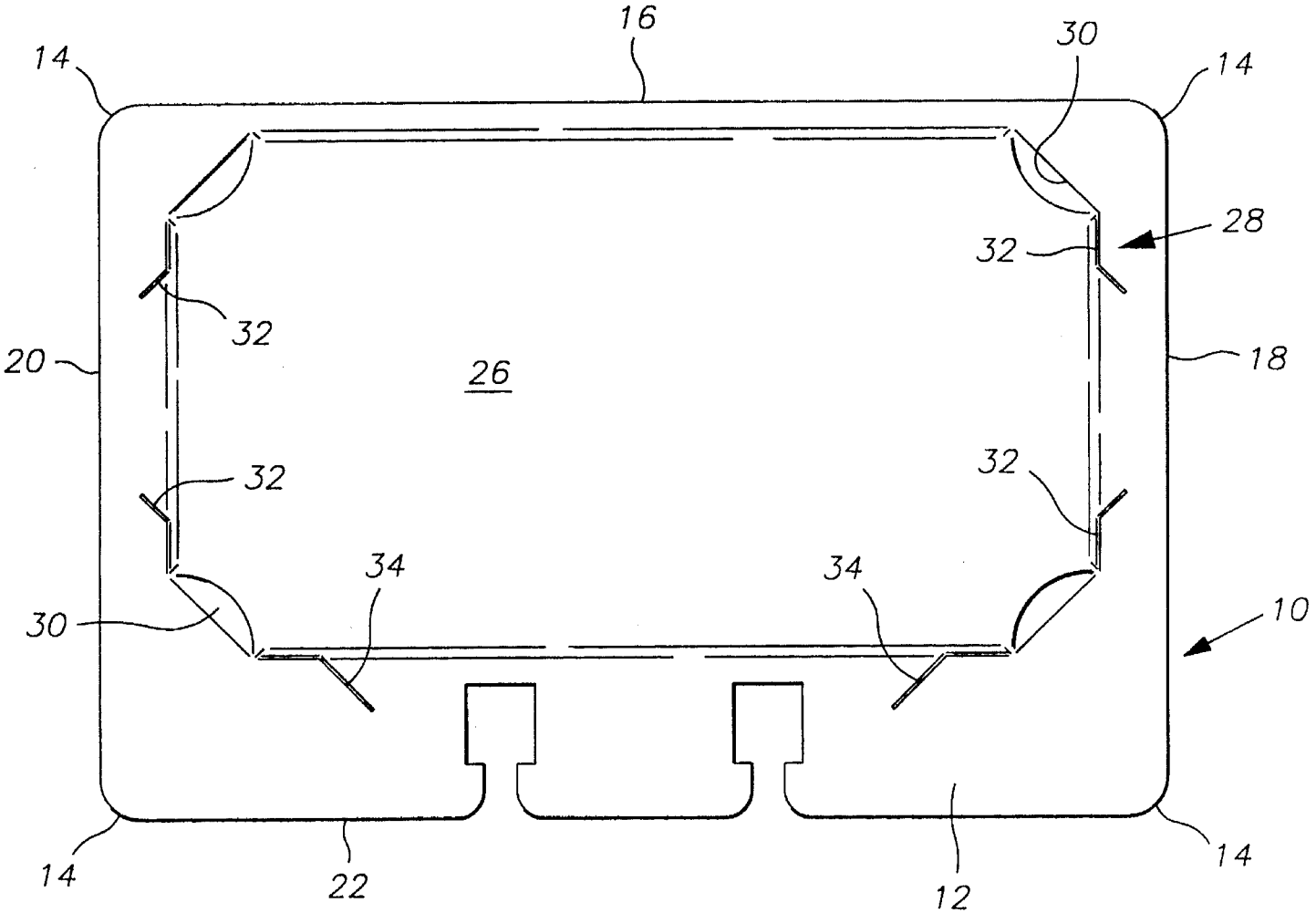
FIG. 6 is a rear elevational view of the card holder of this invention.

As illustrate in FIGS. 1 through 6, the card holder 10 of this invention is made from a rectangular sheet 12 of card stock paper or plastic. With paper, the thickness of the sheet 12 is from about 0.010 to about 0.012 inch. With plastic, the thickness of the sheet 12 is from about 0.005 to about 0.008 inch. Plastic is preferred because it is more durable. Mylar brand plastic is suitable.

The sheet 12 has a width of about 4 inches and a height of from about 2.5 to about 2.70 inches. Preferably, the corners 14 of the sheet 12 are rounded, and the sheet has a top longitudinal edge 16, a pair of opposed side edges 18 and 20, and a bottom longitudinal edge 22. There are adjacent, standard mounting cutouts 23 in the sheet 12 for attaching the card holder 10 to a standard card storage and retrieval system (not shown).

The sheet 12 has a planar surface 24 and a rectangular area 26 displaced parallel to the planar surface 24 a distance approximately equal to the thickness of a standard business card, or about 0.010–0.012 inch. The rectangular area 26 has dimension of about 2 inches by about 3.5 inches. Surrounding the rectangular area 26 is a marginal frame 28. The distance between the outer longitudinal edge 16 and the displaced rectangular area 26 is from about 3/32 to about 1/8 of an inch, the distance between each of the outer side edges 18 and 20 and the displaced rectangular area is from about 1/8 to about 7/16 inch, and the distance between the outer longitudinal bottom edge 22 and the displaced rectangular area is from about 1/2 to about 5/8 inch.

In accordance with this invention, the card holder 10 has a unique structure which captures and removably holds a business card (not shown). This structure comprises at each corner of the rectangular area 26 holes 30 and slits 32 and 34 extending from the holes. The holes 30 are formed by a straight cut 36 in the sheet 12 at an angle of about 45 degrees to an edge 18 or 20, with an adjacent portion of the rectangular area 26 removed to enlarge the cut 36, forming a hole in the shape of a segmented circle. The slits 32 extend outward from an end of the cut 36 near the side edges 18 or 20, and the slits 34 extend outward from opposite ends of the cuts 36 in the holes 30 near the bottom edge 22.

As best depicted in FIG. 1A, each slit 32 has a slit portion 32*a* extending from the end of the cut 36 parallel to the side edges 18 and 20. The length of this slit portion 32*a* is about 1/16 to about 3/16 inch, and it terminates in a slit portion 32*b*. The slit portion 32*b* extends outward towards the adjacent side edge 20 or 18 as the case may be from the end of the slit portion 32*a* at an angle of from 40 to 50 degrees. This slit portion 32*b* has a length of about 1/16 to about 3/16 inch. Each slit 34 has a slit portion 34*a* extending from the end of the cut 36 parallel to the bottom edge 22. The length of the slit portion 34*a* is about 1/16 to about 3/16 inch, and it terminates at a slit portion 34*b*. The slit portion 34*b* extends from the end of the slit portion 34*a* at an angle of from 40 to 50 degrees outward towards the bottom longitudinal edge 22. It has a length of about 1/16 to about 3/16 inch. The the slit portions 32*a* and 34*a* extend along the perimeter of the displaced rectangular area 26.

Because of the unique combination of holes 30 and slits 32 and 34, the card holder 10 captures rectangular business cards varying in size over a range of: width equals 3.5 inches plus or minus 1/4 inch, and height equals 2 inches plus or minus 3/16 inch. The corners of a business card are slipped into the holes 30, and for a business card larger than the standard size, its edges nearby the card's corners are slipped into the slits 32 and 34 and the card is positioned so that it overlies the rectangular area 26, with its edges slightly extending beyond the perimeter of the rectangular area. The body of the business card is cradled in the displaced rectangular area 26, and does not slip from the card holder 10. The business card is held firmly, but may be easily removed from the card holder 10.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

I claim:

1. A business card holder for mounting within a card storage and retrieval system a business card, the card holder comprising:

a thin rectangular sheet having a width of 4 inches and a height between 2.5 and 2.70 inches, said sheet defining a planar surface and having an outer longitudinal top edge, a pair of opposed side edges, and a longitudinal bottom edge;

a rectangular area of the thin sheet is displaced a predetermined distance so that said area is parallel to the planar surface and a marginal frame surrounding said rectangular area is provided, each corner of the rectangular area having a hole adapted to receive a corner of the business card;

the distance between the outer longitudinal edge and the displaced rectangular area being between 3/32 and 1/8 of an inch, the distance between each of the outer side edges and the displaced rectangular area being between 1/8 and 7/16 inch, and the distance between the outer longitudinal bottom edge and the displaced rectangular area being between 1/2 and 5/8 inch;

each hole being formed by a straight cut oriented at approximately 45 degrees to the side edges, with a portion of said rectangular area adjacent the cut being removed to allow the corners of the business card to be more easily inserted into the holes;

extending outward from each hole at an end of the cut a first slit which parallels an adjacent side edge, has a length of an 1/8 inch, and terminates at a second slit;

said second slit extending from the first slit at an angle of from 40 to 50 degrees outward towards a side edge and having a length from 1/16 to 3/16 inch;

extending outward from each hole adjacent the bottom edge a third slit which parallels the bottom edge, has a length from 1/16 to 3/16 inch, and terminates at a forth slit, said forth slit extending from the third slit at an angle of from 40 to 50 degrees outward towards the bottom edge and having a length from 1/16 to a 3/16 inch; and at least one mounting cutout in the sheet for attaching the card holder to the card storage and retrieval system.

2. The business card holder of claim 1 where the first and third slits extend along a perimeter of the rectangular area.

3. A business card holder for mounting a single business card and storing the holder with the business card mounted thereon within a card storage and retrieval system, said business card having a predetermined thickness, the card holder comprising:

a thin rectangular sheet defining a planar surface and having an outer longitudinal top edge, a pair of opposed side edges, and a longitudinal bottom edge;

a rectangular area of the thin sheet recessed from the planar surface and is parallel to the planar surface and a marginal frame surrounding said rectangular area, each corner of the rectangular area having a hole adapted to receive a corner of the business card;

each hole being formed by a straight cut oriented at approximately 45 degrees to the side edges, with a portion of said rectangular area adjacent the cut being removed to allow the corners of the business card to be more easily inserted into the holes;

extending outward from each hole at an end of the cut a first slit which parallels an adjacent side edge and terminates at a second slit;

said second slit extending from the first slit at an angle of from 40 to 50 degrees outward towards a side edge;

extending outward from each hole adjacent the bottom edge a third slit which parallels the bottom edge and terminates at a forth slit, said forth slit extending from the third slit at an angle from 40 to 50 degrees outward towards the bottom edge; and at least one mounting cutout in the sheet for attaching the card holder to the storage and retrieval system.

* * * * *